United States Patent [19]

Allen

[11] Patent Number: 4,771,506

[45] Date of Patent: Sep. 20, 1988

[54] SECURITY DEVICE FOR HINGE SIDE OF A DOOR

[76] Inventor: Mark L. Allen, 1776 E. 13th St., Brooklyn, N.Y. 11229

[21] Appl. No.: 24,301

[22] Filed: Mar. 10, 1987

Related U.S. Application Data

[60] Continuation-in-part of Ser. No. 783,874, Oct. 3, 1985, Pat. No. 4,656,691, which is a division of Ser. No. 522,325, Aug. 11, 1983, Pat. No. 4,547,009.

[51] Int. Cl.[4] ..... E05D 5/06

[52] U.S. Cl. ..... 16/251; 16/268; 16/384; 16/388; 16/392

[58] Field of Search ..... 292/340, 346; 16/250, 16/251, 268, 384, 388, 390, 392

[56] References Cited

U.S. PATENT DOCUMENTS 4,547,009 10/1985 Allen ..... 16/251
4,656,691 4/1987 Allen ..... 16/251

*Primary Examiner*—Nicholas P. Godici
*Assistant Examiner*—Edward A. Brown
*Attorney, Agent, or Firm*—William P. Keegan

[57] ABSTRACT

A hinge-like device for securing the hinge side of a door against "kick-ins." The device comprises a jamb leaf that extends outside the area protected by a closed door so that a buck pin projecting through the extended portion can engage the strongest part of the wall structure. A cover plate is provided to prevent access to and removal of the buck pin, and the cover plate is itself irremovable because its mounting screws are shielded by a closed door. A door leaf secured to the inner surface of the door is loosely fitted to the jamb leaf.

16 Claims, 3 Drawing Sheets

SECURITY DEVICE FOR HINGE SIDE OF A DOOR

FIELD OF THE INVENTION

This invention is a continuation-in-part of application Ser. No. 783,874 filed Oct. 3, 1985, now U.S. Pat. No. 4,656,691 which itself is a divisional application of application Ser. No. 522,325 filed Aug. 11, 1983, now U.S. Pat. No. 4,547,009.

This invention relates to a door security system, and more particularly to an improved article of manufacture which enhances the security offered by a locked door by minimizing the liklihood of the door being ripped from its support on the hinge side of the door.

BACKGROUND OF THE INVENTION

With the increased need and demand for securing exterior doors against unauthorized and forcible entry, there has been a steady development of improved security locks and devices. Such improvements have been directed to pick resistant cylinders, longer and stronger dead bolts, and guard plates to prevent removal of lock cylinders. However, no matter how secure the lock cylinder and bolt are, the fact remains that the bolt generally extends only about one inch into an aperture in the door jamb after passing through a small strike plate mounted on the jamb. The strike plate is usually secured to the jamb by a pair of screws that extend a short distance into the jamb. Moreover, the location of the strike plate and the aperture into which the lock bolt extends is close to the inner edge of the jamb with a relatively thin section of the jamb retaining the bolt against inward movement. Thus, in many instances, a person may cause the bolt to rip through the retaining section of the jamb simply by throwing his weight against the door. Since door hinges are similarly secured near the inner edge of the door jamb by relatively short screws, the same technique can be used to free the door at its hinge side. In this way entry may be gained without disturbing or overcoming the security offered by the lock itself. My aforementioned applications, as well as my patent, U.S. Pat. No. 4,593,546, disclose devices that improve the security of doors.

BRIEF DESCRIPTION OF THE INVENTION

It is an object of the invention to provide an improved door security system.

It is another object of the invention to provide a security device that minimizes the liklihood of the hinge side of a door being ripped from the door frame.

It is another object of the invention to provide an improved door hinge.

It is still another object of the invention to provide a security device that may be applied to the hinge side of a door and door frame while the door is supported on the frame by conventional door hinges.

In carrying out the invention, a hinge having a jamb leaf that extends outside the area protected by a closed door is provided with an elongated buck pin that extends into the door jamb a relatively long distance and into an abutting relationship with the central section of the basic wall structure, thus minimizing the liklihood of the hinge being ripped from the door jamb when a force is applied to a closed door adjacent the hinges. A further embodiment of the invention employs a similar jamb leaf, but the door leaf is secured to the inner surface of the door and is loosely connected to the jamb leaf. This latter embodiment of the invention does not function as a door supporting hinge, but is intended to supplement the conventional door hinges and improve the security at the hinge side of the door.

DETAILED DESCRIPTION OF THE INVENTION

Figure 1:
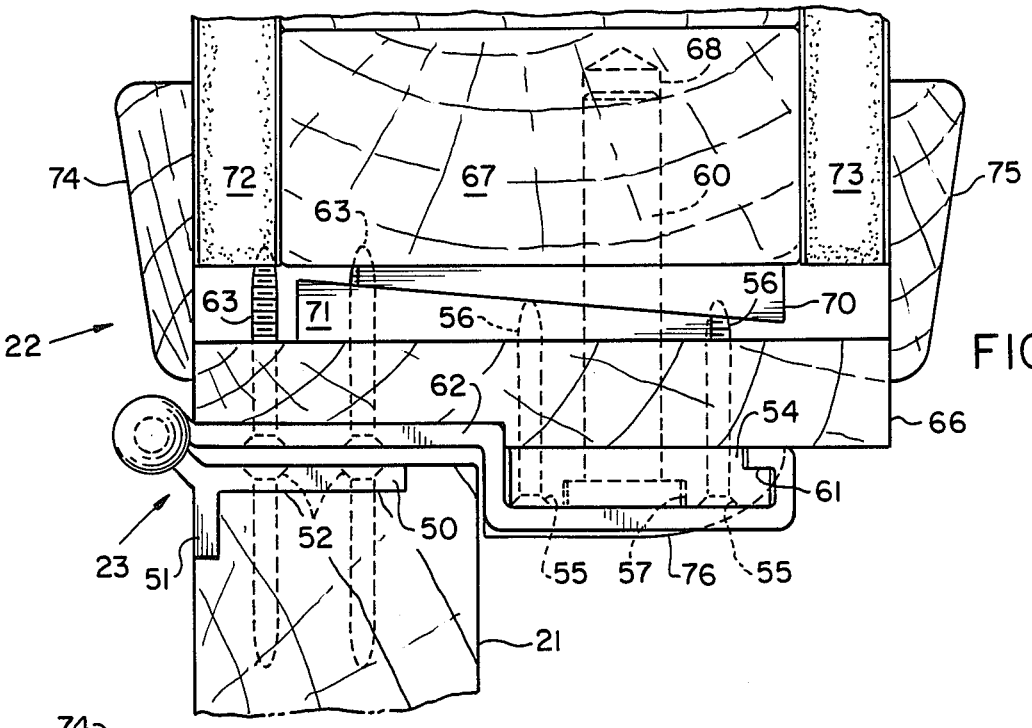
FIG. 1 is a top plan view of an improved door hinge according to the present invention.

Referring to FIG. 1 of the drawings, a typical inwardly swinging apartment entry door 21 is supported on the door frame 22 by an upper and a lower hinge, not shown.

As previously noted, the security afforded by door 21 depends to a great extent on the dead bolt actuated by the door lock cylinder extending into the door jamb and the screws securing the door supporting hinges to the opposite door jamb. The dead bolt extends through a strike plate mounted on the face of the door jamb about an inch into the door jamb itself. The point at which the dead bolt enters the door jamb is relatively near the inner edge of the jamb. Similarly, the screws securing the door supporting hinges to the door jamb do not extend too far into the jamb nor are they far from the inner edge thereof. The arrangement is such that a violent force applied against the outside of door 21 can cause the dead bolt or the hinge screws to tear through the relatively thin section of the door jamb opposing such a force.

An improved strike plate and an improved hinge that enhance the security offered by the typical entry door are described in my earlier applications referred to above and a description thereof will not be repeated here.

Figure 2:
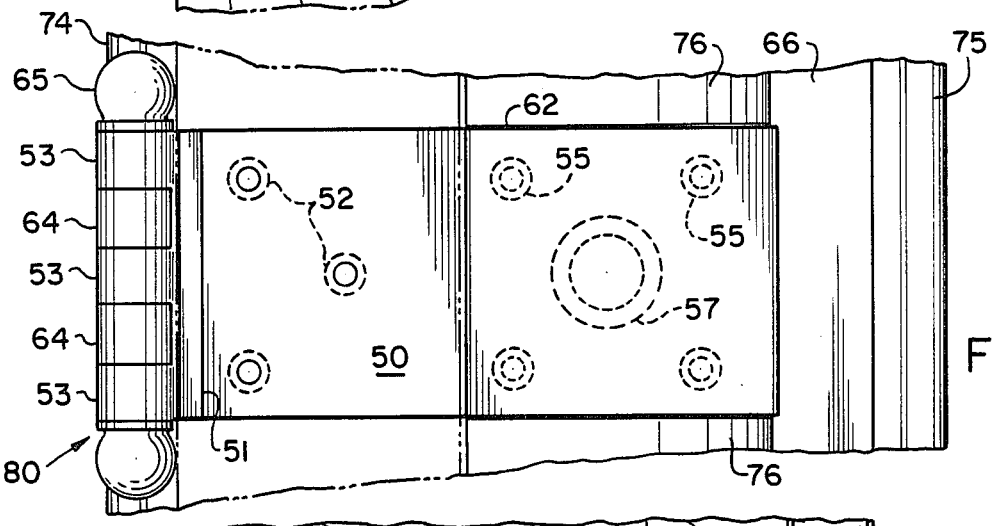
FIG. 2 is a front elevational view of the hinge shown in FIG. 1.

FIGS. 1 and 2 illustrate another door hinge 23 that embodied the buck pin feature already described in my earlier applications. Here, the door leaf 50 is provided with an angle arm 51 that helps prevent door 21 from being ripped from leaf 50 when a force is applied to the outside of the door. Leaf 50 is also provided with the usual screwholes 52 and door leaf barrel segments 53 by which the door leaf is joined to the jamb leaf.

The part of hinge 23 that is secured to the door jamb comprises a buck pin plate 54 which is provided with screwholes 55 by which the plate is secured to the door jamb, at the location shown in the drawing, by screws 56. A central aperture 57 in plate 54 accommodates the elongated buck pin 60 which extends through the aperture into an aperture drilled into the center of the two by four's forming the structural support for the wall. Buck pin 60 is, preferably, a separate bolt or screw member, but it could be welded to plate 54. A dado 61 is formed in plate 54 and the jamb leaf 62 of hinge 23, shaped as shown in FIG. 1, is fitted into dado 61 and secured to the door jamb by screws 63. Thus, jamb leaf 62, the securing screws 63 of which are protected or covered by the closed door 21, covers and precludes access to buck pin plate 54 and the screws 56 securing it to the door jamb.

With leaves 50 and 62 secured to the door and the door jamb, respectively, the door is positioned so that barrel segments 53 on door leaf 50 interleaf and align with barrel segments 64 of jamb leaf 62, after which pivot pin 65 is passed through barrel segments 53 and 64 to pivotally support door 21 on the jamb. Of course, an upper and a lower hinge of the type just described are used to mount or hang the door.

The door jamb to which buck pin plate 54 and jamb leaf 62 are secured comprises a door frame member 66 which is nailed (nails not shown) to the end stud 67 of the wall adjacent the door opening. Generally, this last stud comprises a double two by four for added strength around the opening. Frame member 66 is spaced from stud 67 by a pair of tapered spacing pieces 70 and 71 which enable member 66 to be located to provide the proper door opening width. The inner wall 72 and the outer wall 73 are shown as sheetrock panels. Molding strips 74 and 75 are also illustrated, as is door stop 76 against which door 21 normally abuts when in a closed position. An aperture 68 is provided to receive buck pin 60. It is clear that hinge 23 provided with buck pin 60 materially strengthens the hinge side of the door, and for all intents and purposes, eliminates the possibility of forcing the door open on the hinge side by ripping the hinge screws from the door jamb.

Other type wall structures, such as masonry walls, may be found in some apartments, but the improved hinge of the present invention may be used on door frames set in such walls. The buck pin would simply project into apertures provided in the masonry instead of into apertures provided in a two by four stud.

While the hinge described with reference to FIGS. 1 and 2 is suitable for new installations when a door is first hung, or when a door is re-hung, the security device 80 shown in FIGS. 3 and 4 can be used on doors that are already installed using conventional hinges.

Figure 3:
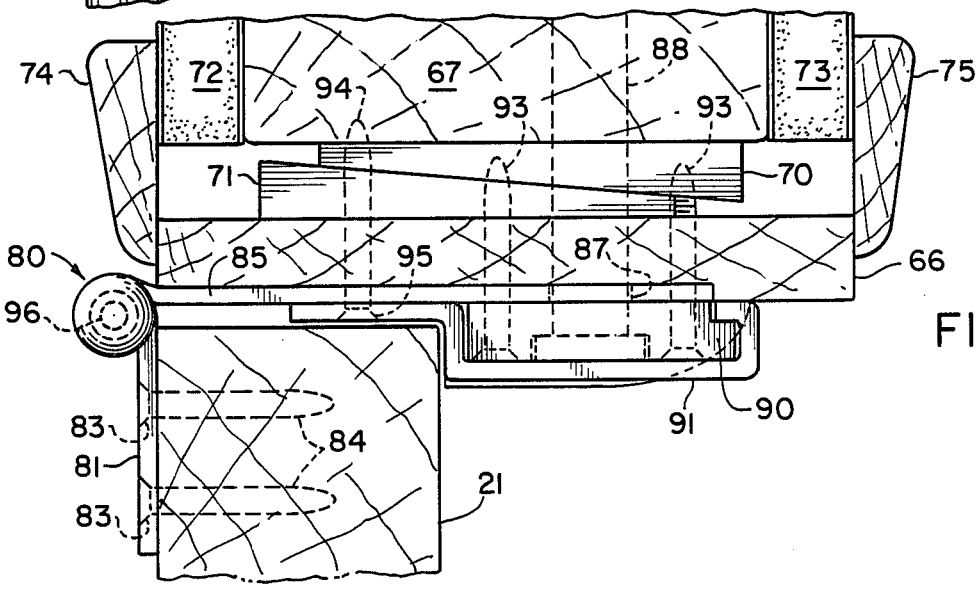
FIG. 3 is a top plan view of an improved security device according to the present invention.
Figure 4:
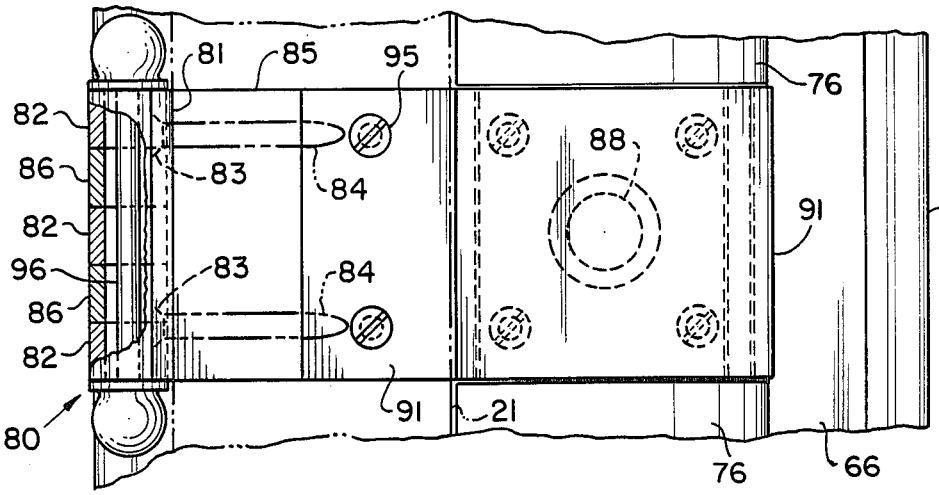
FIG. 4 is a front elevational view of the FIG. 3 device.

Referring now to FIGS. 3 and 4, the door jamb structure is the same as that shown in FIG. 1 and the same reference numerals are applied thereto. Therefore, the structure will not be described again. Security device 80 comprises a door leaf 81 formed with barrel segments 82. The door leaf is provided with screwholes 83 and is secured to the inner surface of door 21 by screws 84. The jamb assembly comprises a jamb leaf 85 formed with barrel segments 86 and provided with screwholes for accommodating fastening screws hereinafter described and a larger aperture 87 through which buck pin 88 projects. A buck pin plate 90 is also provided with screwholes for fastening screws and a central aperture through which buck pin 88 projects. A cover plate 91, shaped as shown, is provided to prevent access to the screws securing plate 90 to the door jamb and to buck pin 88. Cover plate 91 is hooked into a dado formed in plate 90.

Security device 80 will generally be installed midway between the top and bottom of door 21 on the hinge side of the door. It will be noted that the door is already supported by conventional hinges and that the door need not be removed from the hinges to install device 80. The door leaf 81 is secured to the inside surface of door 21 by screws 84. From the inside, jamb leaf 85 is slipped through the space between the edge of door 21 and the door jamb, with the barrel segments 86 thereof interleaved with those of door leaf 81. If the door is tight fitting, it may be necessary to mortise the door jamb or the edge of door 21 to accommodate leaf 85. Buck pin plate 90 is aligned with leaf 85 so that buck pin 88 can project through the apertures provided in both plate 90 and leaf 85 for the buck pin. Screws 93 then secure plate 90 and leaf 85 to the door jamb. Cover plate 91 is then positioned over plate 90 and buck pin 88, as shown, and secured to the door jamb by screws 94 which pass through screwholes 95 in cover plate 91 and aligned screwholes in leaf 85. It will be noted that access to screws 94 is prevented by the closed door 21. A loose pin 96 is then inserted through the interleaved barrel segments 82 and 86 to, in effect, connect door leaf 81 to jamb leaf 85. Pin 96 is made loose fitting so as to obviate the need to align security device 80 with the conventional hinges supporting the door. Device 80 is not intended to support the door in its normal pivotal operation, but simply to resist and prevent the door being kicked-in at its hinged side and the conventional hinges mounted in the conventional way ripped from the door jamb. The securely positioned buck pin prevents inward movement of the door.

Figure 5:
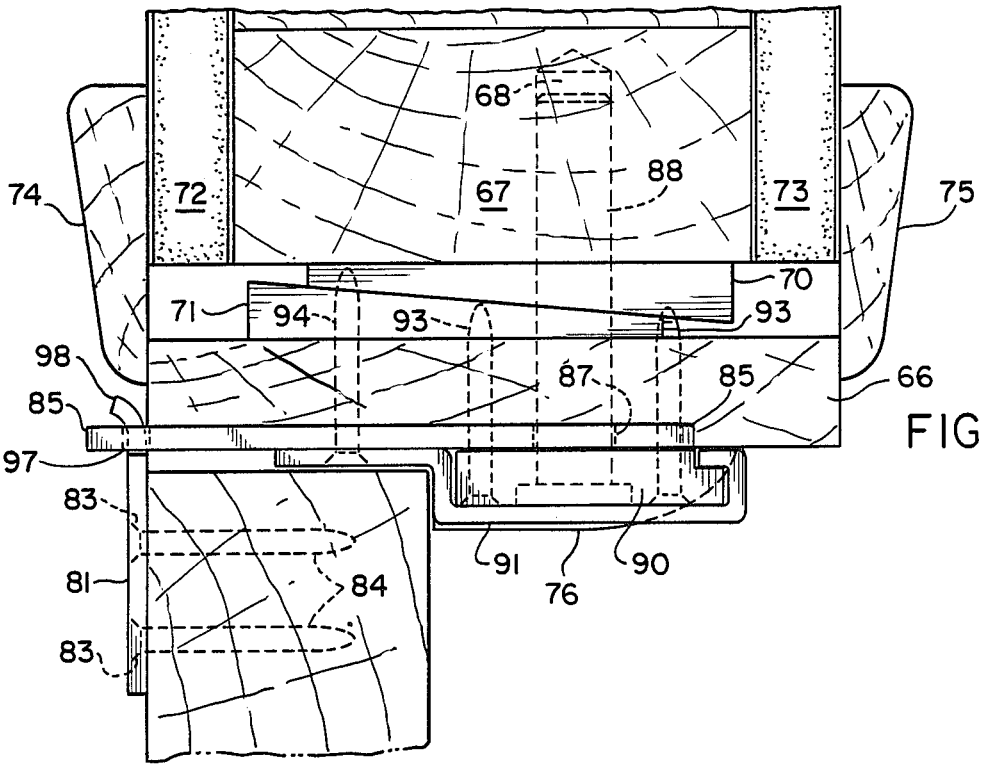
FIGS. 5 and 6, respectively, are a top plan view and a front elevational view of another embodiment of the device shown in FIGS. 3 and 4.
Figure 6:
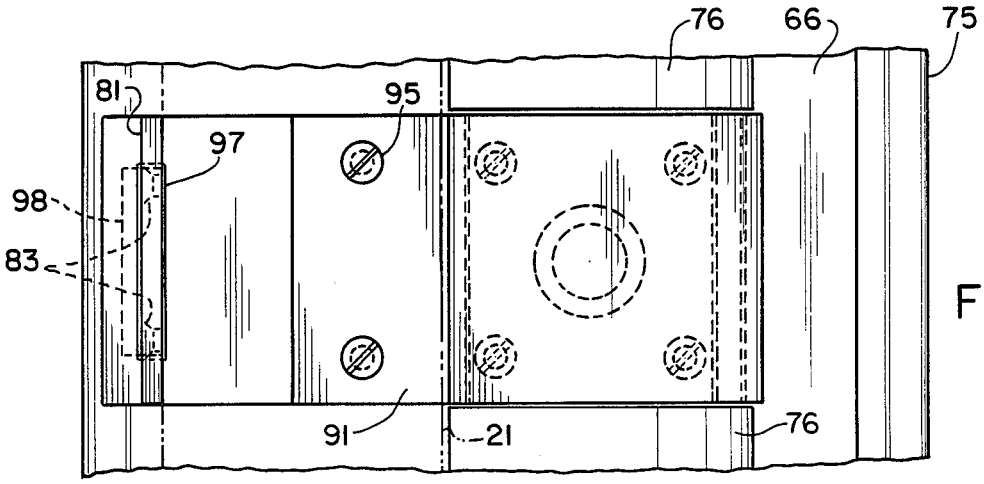

The embodiment shown in FIGS. 5 and 6 is identical to that shown in FIGS. 3 and 4 except that the barrel segments 82, 86 on door leaf 81 and on jamb leaf 85, respectively, and loose pin 96 are not provided. Instead, jamb leaf 85 is provided with a slot 97 and door leaf 81 is provided with a curved tab 98 that extends through slot 97. Otherwise, the parts of the security device are the same as those shown in FIGS. 3 and 4, and are similarly numbered.

Figure 7:
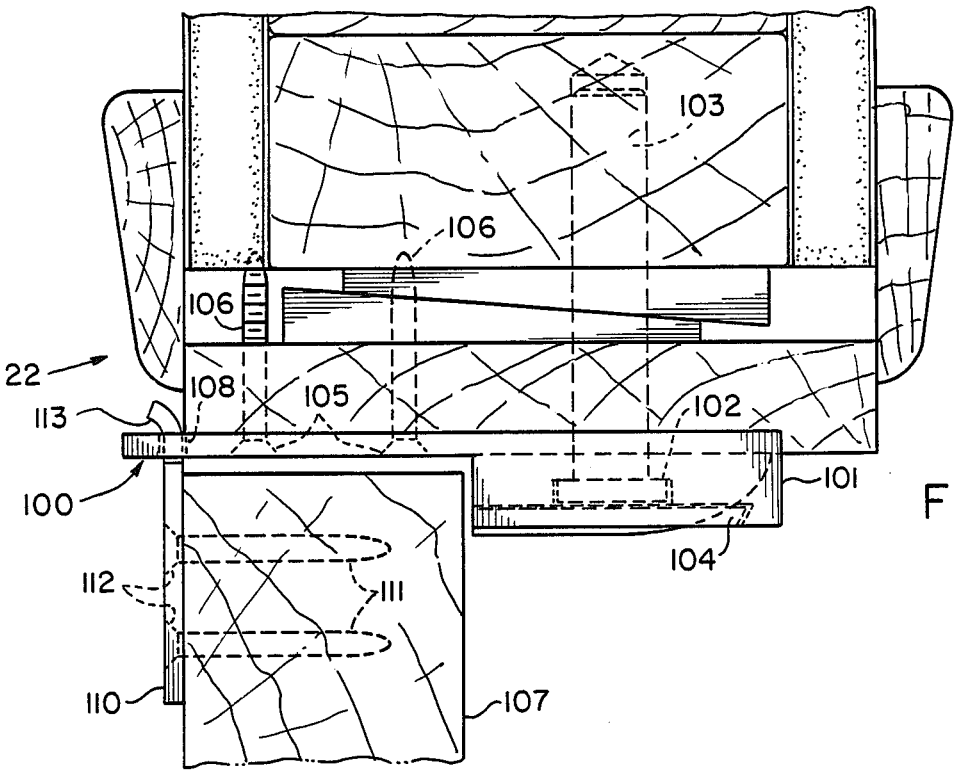
FIG. 7 is a top plan view of still another embodiment of the invention.
Figure 8:
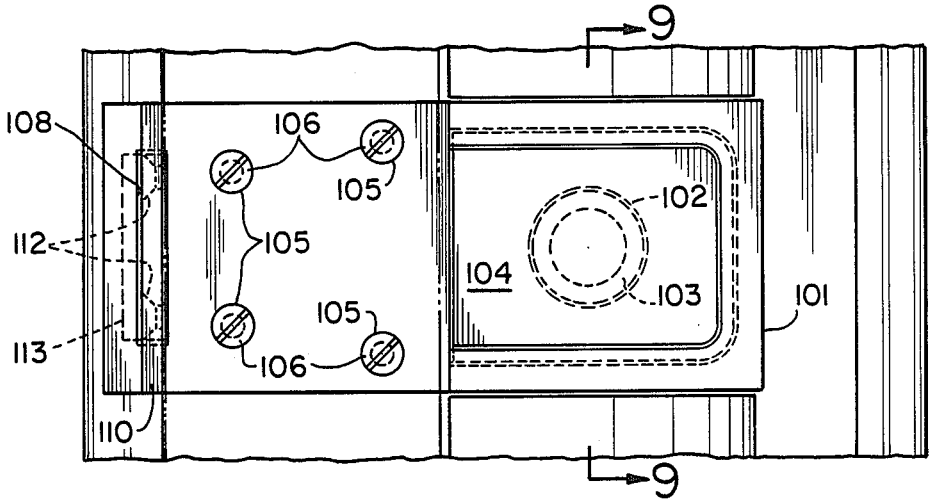
FIG. 8 is a front elevational view of the FIG. 7 embodiment.
Figure 9:
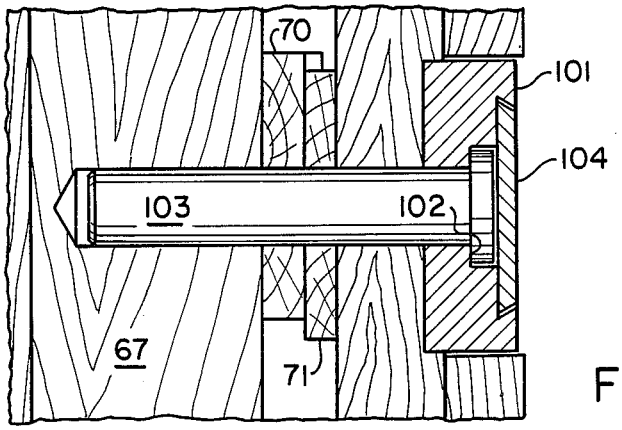
FIG. 9 is a sectional view taken on line 9—9 of FIG. 8.

Another embodiment of the invention is shown in FIGS. 7 to 9. In this embodiment, jamb leaf 100 is shown with an extension 101 provided on three sides with inwardly inclined walls and a central shouldered aperture 102 through which a shouldered buck pin 103 projects. The part of the extension that would be abutted by a closed door (see FIG. 7) is not provided with a wall, but rather is open so that a cover plate 104, trapezoidal in cross section as shown in FIG. 9, can be slipped into the mortise formed by the wall structure of the extension and thus prevent access to buck pin 103.

Jamb leaf 100 is also provided with screwholes 105 to accommodate screws 106 that will secure leaf 100 to the door jamb. It will be noted that, in use, screws 106 would be inaccessable when door 107 is closed. A slot 108 is provided on a part of the jamb leaf that projects inwardly of the closed door.

A door leaf 110 which is secured to the inner surface of door 107 by screws 111 passing through screwholes 112 is provided with a curved tab 113 that extends loosely through slot 108 of jamb leaf 100.

Having thus described the invention, it is to be understood that many apparently different embodiments thereof can be made without departing from the spirit and scope of the invention. For example, the jamb leaf of the hinge of FIG. 1 could be modified so as to use a dovetail coverplate such as coverplate 104 shown in the FIGS. 7 to 9 embodiment. Also, the jamb leaf of FIG. 3 could similarly be modified to use a dovetail coverplate. Therefore, it is intended that the foregoing specification and the accompanying drawing be interpreted as illustrative rather than in a limiting sense.

What is claimed is:

1. A door security device for the hinge side of an entry door supported in a door opening in a wall framed by a door jamb secured to a wall supporting structural element, said device comprising: a door leaf member for securing the device to the door; buck pin plate means having an elongated buck pin projecting perpendicularly therefrom, said plate means being adapted to be secured by screws to the door jamb in a location outside the area covered by the closed door so that said buck pin engages wall supporting structural element; an extended jamb leaf means including a first part having a section to cover said plate means and prevent access to screws securing said plate means to the door jamb and a hooked end for engaging said plate means to prevent movement of said jamb leaf means along the door jamb away from said plate means, and a second part adapted to be screwed to the door jamb in the area covered by the closed door; and means connecting said door leaf member and said jamb leaf means for pivotal movement therebetween.

2. A device according to claim 1 wherein said door leaf member and said jamb leaf means are provided with barrel segments that interleave, and wherein said connecting means is a pin means extending through said barrel segments.

3. A device according to claim 2 wherein said door leaf member is an L-shaped member, one arm of which abuts the edge of the door and the other arm of which abuts the inner surface of the door, and wherein said pin means is a tight fitting pivot pin, whereby said device functions as a door supporting hinge.

4. A device according to claim 3 wherein said buck pin plate means includes a plate member having a shouldered aperture therein and a separate shouldered buck pin.

5. A device according to claim 2 wherein said door leaf member abuts the inner surface of the door and wherein said pin means is a loose fitting pin which prevents the interleaved barrel segments from disengaging, whereby the device does not function as a door supporting hinge.

6. A device according to claim 5 wherein said buck pin plate means includes a plate member having a shouldered aperture therein and a separate shouldered buck pin.

7. A device according to claim 3 wherein said jamb leaf means comprises: a flat jamb leaf having a first part adapted to be secured between said buck pin plate means and the door jamb, said first part being formed with an aperture through which said buck pin projects, and a second part provided with screwholes that will be covered by the closed door; and a cover plate for covering said buck pin plate means, said cover plate having a hooked end for engaging said buck pin plate means, said cover plate having screwholes that align with the screwholes of said jamb leaf when said cover plate is in hooked engagement with said buck pin plate means so that said jamb leaf and said cover plate are secured to the door jamb by the same screws.

8. A device according to claim 7 wherein said buck pin plate means includes a plate member having a shouldered aperture therein and a separate shouldered buck pin.

9. A device according to claim 5 wherein said jamb leaf means comprises: a flat jamb leaf having a first part adapted to be secured between said buck pin plate means and the door jamb, said first part being formed with an aperture through which said buck pin projects, and a second part provided with screwholes that will be covered by the closed door; and a cover plate for covering said buck pin plate means, said cover plate having a hooked end for engaging said buck pin plate means, said cover plate having screwholes that align with the screwholes of said jamb leaf when said cover plate is in hooked engagement with said buck pin plate means so that said jamb leaf and said cover plate are secured to the door jamb by the same screws.

10. A device according to claim 9 wherein said buck pin plate means includes a plate member having a shouldered aperture therein and a separate shouldered buck pin.

11. A device according to claim 1 wherein said buck pin plate means includes a plate member having a shouldered aperture therein and a separate shouldered buck pin and wherein said jamb leaf means comprises: a flat jamb leaf having a first part adapted to be secured between said buck pin plate member and the door jamb, said first part being formed with an aperture through which said buck pin projects, and a second part provided with screwholes that will be covered by the closed door; and a cover plate for covering said plate member, said cover plate having a hooked end for engaging said plate member, said cover plate having screwholes that align with the screwholes of said jamb leaf when said cover plate is in hooked engagement with said plate member so that said jamb leaf and said cover plate are secured to the door jamb by the same screws; and wherein said means connecting said door leaf member and said jamb leaf means comprises a slot formed in said jamb leaf means and a tab means formed on said door leaf member that projects through said slot.

12. A door security device for the hinge side of an entry door supported in a door opening in a wall framed by a door jamb secured to a wall supporting structural element, said device comprising: a door leaf member for securing the device to the door; an extended jamb leaf means including a first part adapted to be screwed to the door jamb in the area covered by the closed door and a buck pin part extending outside the area covered by the closed door, said buck pin part being provided with a shouldered aperture adapted to align with the wall supporting structural element and upstanding sidewalls along its edges except for the edge that is adjacent the closed door so as to surround said aperture, at least those sidewalls extending from the closed door being inwardly inclined to provide a dovetail arrangement; an elongated shouldered buck pin adapted to project through said aperture provided in said buck plate means part of said jamb leaf and into the wall supporting structural element; a cover plate having at least two opposite edges thereof tapered inwardly so that said cover plate can be slipped into position covering said aperture and dovetailing with said sidewalls when the door is open, said cover plate being irremovable when the door is closed; and means connecting said door leaf member and said jamb leaf means for pivotal movement therebetween.

13. A device according to claim 12 wherein said door leaf member and said jamb leaf means are provided with barrel segments that interleave, and wherein said connecting means is a pin means extending through said barrel segments.

14. A device according to claim 13 wherein said door leaf member is an L-shaped member, one arm of which abuts the edge of the door and the other arm of which abuts the inner surface of the door, and wherein said pin means is a tight fitting pivot pin, whereby said device functions as a door supporting hinge.

15. A device according to claim 13 wherein said door leaf member abuts the inner surface of the door and wherein said pin means is a loose fitting pin which prevents the interleaved barrel segments from disengaging, whereby the device does not function as a door supporting hinge.

16. A device according to claim 12 wherein said means connecting said door leaf member and said jamb leaf means comprises a slot formed in said jamb leaf means and a tab means formed on said door leaf member that projects through said slot.

* * * * *